US007767298B2

(12) United States Patent
Nakatsuka et al.

(10) Patent No.: US 7,767,298 B2
(45) Date of Patent: Aug. 3, 2010

(54) ELECTRICALLY CONDUCTIVE COMPOSITE FIBER AND PROCESS FOR PRODUCING THE SAME

(75) Inventors: Hitoshi Nakatsuka, Osaka (JP); Tadayoshi Koizumi, Kurashiki (JP); Kazuhiko Tanaka, Osaka (JP); Nobuhiro Koga, Kurashiki (JP); Masao Kawamoto, Kurashiki (JP); Kenichi Yoshioka, Saijo (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 276 days.

(21) Appl. No.: 12/090,921

(22) PCT Filed: Oct. 13, 2006

(86) PCT No.: PCT/JP2006/320446

§ 371 (c)(1),
(2), (4) Date: Apr. 21, 2008

(87) PCT Pub. No.: WO2007/046296

PCT Pub. Date: Apr. 26, 2007

(65) Prior Publication Data

US 2009/0117800 A1 May 7, 2009

(30) Foreign Application Priority Data

Oct. 21, 2005 (JP) ..... 2005-307093
Jan. 11, 2006 (JP) ..... 2006-003567

(51) Int. Cl.
*D02G 3/00* (2006.01)

(52) U.S. Cl. ..... 428/373; 428/370; 428/374; 264/171.1; 264/210.5

(58) Field of Classification Search ..... 428/365, 428/370, 373, 374; 264/10–4, 171.1, 210.5, 264/210.8, 211.12, 211.14; 442/220
See application file for complete search history.

(56) References Cited

U.S. PATENT DOCUMENTS 5,059,482 A * 10/1991 Kawamoto et al. ..... 428/373

(Continued)

FOREIGN PATENT DOCUMENTS

JP 57 29611 2/1982

(Continued)

OTHER PUBLICATIONS

U.S. Appl. No. 12/307,147, filed Dec. 31, 2008, Nakatsuka et al.

(Continued)

*Primary Examiner*—N. Edwards
(74) *Attorney, Agent, or Firm*—Oblon, Spivak, McClelland, Maier & Neustadt, L.L.P.

(57) ABSTRACT

An electrically conductive composite fiber comprising an electrically conductive layer formed of a polyester-based polymer (A) having a melting point of 200° C. or higher and containing from 23 to 33% by weight of electrically conductive carbon black, and a protective layer formed of a polyester-based polymer (B) having a melting point of 210° C. or higher, wherein the difference between the SP value of the (A) and the SP value of the (B) is adjusted to not greater than a predetermined value and the fiber strength and the elongation at break are adjusted within certain ranges. This can make it possible to obtain an electrically conductive composite fiber that has a superior antistatic performance, which is not degraded very much over a practical wearing for a long term, though it contains only a relatively small amount of electrically conductive carbon black, and that is suitable for the field of clothing such as clean room wears and working wears.

10 Claims, 2 Drawing Sheets

U.S. PATENT DOCUMENTS

| | | | | |
|---|---|---|---|---|
| 6,811,874 | B2 * | 11/2004 | Tanaka et al. | 428/370 |
| 2009/0117800 | A1 * | 5/2009 | Nakatsuka et al. | 442/199 |
| 2009/0318049 | A1 * | 12/2009 | Nakatsuka et al. | 442/200 |

FOREIGN PATENT DOCUMENTS

| | | |
|---|---|---|
| JP | 58 132119 | 8/1983 |
| JP | 4 153306 | 5/1992 |
| JP | 9 31749 | 2/1997 |
| JP | 9 279416 | 10/1997 |
| JP | 2001 172825 | 6/2001 |
| JP | 2003 278031 | 10/2003 |
| JP | 2004 225214 | 8/2004 |
| JP | 2005 2535 | 1/2005 |

OTHER PUBLICATIONS

U.S. Appl. No. 12/282,411, filed Sep. 10, 2008, Koizumi et al.

* cited by examiner

ELECTRICALLY CONDUCTIVE COMPOSITE FIBER AND PROCESS FOR PRODUCING THE SAME

TECHNICAL FIELD

The present invention relates to an electrically conductive composite fiber having excellent antistatic performance, especially an electrically conductive composite fiber which has antistatic performance excellent in fiber properties and practical wearing durability and also has excellent acid resistance. More particularly, the invention relates to an electrically conductive composite fiber comprising an electrically conductive layer formed of a polyester-based polymer (A) having a melting point of 200° C. or higher and containing a predetermined amount of electrically conductive carbon black and a protective layer formed of a polyester-based polymer (B) having a melting point of 210° C. or higher. The electrically conductive composite fiber has a superior antistatic performance, which is not degraded very much over a practical wearing for a long term though it contains only a relatively small amount of electrically conductive carbon black, and it is suitable for the field of clothing such as clean room wears and working wears.

BACKGROUND ART

Various proposals about electrically conductive fibers have conventionally been made. For example, an electrically conductive fiber obtained by plating metal onto the surface of a fiber having no electrical conductivity is known. However, there is a problem with such an electrically conductive fiber having a metal plating layer on its surface that the electrically conducting performance is degraded because the plating layer on the surface readily exfoliates during a knitting/weaving process or its following process or the plating layer is readily dissolved and removed during a dyeing treatment or a refining treatment of textile.

Metal fiber is known as another type of electrically conductive fiber. It, however, has problems that metal fiber is high in cost and poor in spinnability. Further, it causes troubles during the knitting/weaving process or dye-finishing process, it readily breaks or exfoliates in washing during wearing, and it readily gathers rust.

In place of such known technologies using metal, an electrically conductive composite fiber is known which is obtained by adding electrically conductive carbon black to a polymer, causing the resultant to exist in the form of an electrically conductive layer on the surface of or inside a fiber continuously along the longitudinal direction of the fiber, and composite spinning the resultant with another fiber-forming polymer. It, however, has the following problem: in order to obtain electrically conducting performance by using a polymer to which electrically conductive carbon black has been added (hereinafter, referred to as an electrically conductive layer), a large amount of electrically conductive carbon black must be added to the polymer, whereas if a large amount of carbon black is added, the spinnability and stretchability of the polymer are degraded abruptly. As a method for solving problems caused by stretching, a method including no stretching is conceivable. However, when stretching is not performed, the fiber itself has a low strength and the carbon black in the electrically conductive layer fails to form the structure described infra, and therefore no satisfactory electrically conducting performance will be obtained. Moreover, such a method has a drawback that if the stretching is performed by force, the electrically conductive layer will be broken in the fiber or, even if it is not broken, the structure of the electrically conductive carbon black will be broken or the electrically conductive layer will be broken readily when a slight external force is applied to the electrically conductive fiber, and as a result the electrically conducting performance will be lost.

There is another problem that an electrically conductive layer containing large amount of carbon black shows a low adhesiveness to another polymer constituting the fiber and, as a result, interfacial peeling will occur readily during a process for producing woven/knitted fabrics or during the use as an electrically conductive product to change the electrically conductive layer to a sole fiber and an electrically conductive layer with a low strength and elongation at break will be broken easily (see, for example, patent documents 1, 2).

Furthermore, electrically conductive fibers have been used in dust-proof clothing in order to prevent fine dust from adhering to clothing due to static electricity. In conventional electrically conductive fibers, polyamide-based resins, to which a large amount of electrically conductive carbon black can be added, have been used as a resin for electrically conductive layers. The site of semiconductor manufacture is a typical example of the industry where persons work while wearing dust-proof clothing. The manufacture of semiconductors includes a step of washing a semiconductor or its raw material with acid. Dust-proof clothing used in such a workplace is required to have acid resistance. Generally, however, when the resin used in electrically conductive fibers is a polyamide-based resin, there is a problem that the electrically conductive fibers using the polyamide-based resin can not be used in dust-proof clothing because polyamide resin is poor in acid resistance. Moreover, there are many dust-proof sites where acid may be used or contacted other than the sites of semiconductor manufacture. Therefore, sale of dust-proof clothing which can not be used in workplaces where acid is used is limited greatly.

Patent document 1: JP 57-29611 A

Patent document 2: JP 58-132119 A

DISCLOSURE OF THE INVENTION

Problem to be Solved by the Invention

The present invention eliminates the problems with the existing electrically conductive fibers, namely, that the strength of fiber itself is low, that an electrically conductive layer is readily broken, that no satisfactory electrically conducting performance is obtained, and that an electrically conductive layer readily exfoliates. Moreover, the present invention provides an electrically conductive composite fiber superior to the conventional electrically conductive fibers in acid resistance and durability.

Objectives of the present invention include to provide an electrically conductive composite fiber that has excellent antistatic performance which is maintained for a long period with almost no degradation even over a continuous use for a long term, and that is also excellent in acid resistance, while conventional electrically conductive composite fibers have not been able to fully achieve these performance. Further, objectives of the present invention include to provide a method for producing the same, and to provide dust-proof clothing using such a fiber.

Means for Solving the Problem

The present invention provides an electrically conductive composite fiber comprising an electrically conductive layer formed of a polyester-based polymer (A) having a melting point of 200° C. or higher and containing from 23 to 33% by weight of electrically conductive carbon black, and a protective layer formed of a polyester-based polymer (B) having a melting point of 210° C. or higher, wherein the electrically conductive composite fiber satisfies the following formulas (I) to (III):

$$0 \leqq |\phi 1 - \phi 2| \leqq 1.1 \quad \text{(I)}$$

$$1.8 \leqq DT \leqq 4.5 \quad \text{(II)}$$

$$50 \leqq DE \leqq 90 \quad \text{(III)}$$

wherein, $\phi 1$ means an SP value $[(cal/cm^3)^{1/2}]$ of the polyester-based polymer (A), $\phi 2$ means an SP value $[(cal/cm^3)^{1/2}]$ of the polyester-based polymer (B), DT means the fiber strength (cN/dtex), and DE means the elongation at break (%).

It is preferable that the electrically conductive composite fiber satisfies the following formulas (IV) to (VI):

$$3 \leqq N \leqq 8 \quad \text{(IV)}$$

$$25 \leqq S \leqq 45 \quad \text{(V)}$$

$$1.0 \times 10^9 \leqq E' \leqq 6.0 \times 10^9 \quad \text{(VI)}$$

wherein N means the number of exposed portions of the electrically conductive layer, S means the surface exposed area ratio (%) of the electrically conductive layer relative to the entire surface of the fiber, and E' means the storage elastic modulus (Pa) at 10 Hz, 100° C.

It is preferable that in a profile of the electrically conductive layer in a cross section of the fiber taken along the direction perpendicular to the axis of the fiber, the ratio ($D_1/L_1$) of the thickness ($D_1$) of the electrically conductive layer to the length ($L_1$) of an exposed portion on the fiber surface is from 0.15 to 1.0. It is also preferable that the cross-sectional shape of the electrically conductive layer is a shape similar to the cross-sectional shape of a biconvex lens and the weight ratio of the electrically conductive layer to the fiber is within the range of from 5 to 15% by weight.

It is also preferable that the electrically conductive composite fiber is a sheath/core composite fiber having the electrically conductive layer as a sheath component and the protective layer as a core component and the weight ratio of the electrically conductive layer relative to the composite fiber is within the range of from 15 to 50% by weight.

It is preferable that the polyester-based polymer (A) constituting the electrically conductive layer of the electrically conductive composite fiber is a polybutylene terephthalate-based resin and the polyester-based resin (B) constituting the protective layer is a polyethylene terephthalate-based resin. It is also preferable that the polyester-based resin (B) constituting the protective layer contains inorganic particles having an average particle diameter of from 0.01 to 1 μm in an amount of from 0.05 to 10% by weight.

A multifilament comprising a bundle of from 3 to 6 fibers each being the electrically conductive composite fiber, wherein the multifilament has a total fineness of from 10 to 40 dtex is one preferable embodiment. Dust-proof clothing comprising a fabric in which the electrically conductive composite fiber is arranged as a warp or a weft at intervals is also a preferable embodiment.

Moreover, the present invention is directed to a method for producing an electrically conductive composite fiber by compositely spinning a polyester-based polymer (A) having a melting point of 200° C. or higher and containing from 23 to 33% by weight of electrically conductive carbon black and a polyester-based polymer (B) having a melting point of 210° C. or higher, wherein the following (1) to (5) are performed in this order in a manner that the following (6) is satisfied:

(1) merging a molten polymer liquid of the (A) and a molten polymer liquid of the (B), followed by melt-discharging through a composite spinneret, (2) cooling the discharged molten polymer temporarily to a temperature lower than a glass transition point, (3) subsequently transfer it through a heating device to subject heat-stretching treatment, (4) thereafter providing oil to it, (5) winding it at a rate of 3000 m/min or more, (6) the (1) to (3) are performed before the discharged thread comes into contact with a roller or a guide at first.

Effect of the Invention

The electrically conductive composite fiber of the present invention has excellent antistatic performance which is maintained for a long period with almost no degradation even over a continuous use for a long term, and further is excellent in acid resistance, while conventional electrically conductive composite fibers have not been able to fully achieve these performances. Therefore, it can be used in the field of dust-proof clothing, in which conventional electrically conductive fibers have not been able to be used. Moreover, it can be used as fibers of working wears in other fields where prevention of antistatic electricity generation is required or as fibers of antistatic brushes of copying machines.

EXPLANATION OF REFERENTIAL SYMBOLS

A: Electrically conductive polymer layer

B: Protective polymer layer

BEST MODE FOR CARRYING OUT THE INVENTION

Figure 1:
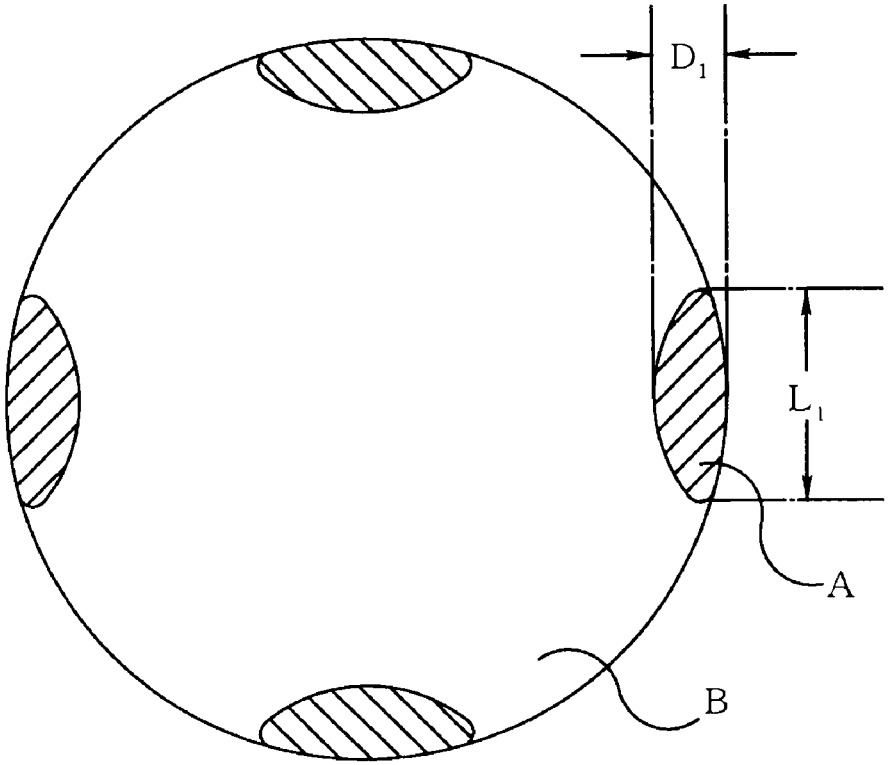
FIG. 1 A cross sectional view showing one example of the composite form of the electrically conductive composite fiber of the present invention.

First, in the present invention, the electrically conductive composite fiber comprises an electrically conductive layer formed of a polyester-based polymer (A) containing electrically conductive carbon black, which may hereinafter be referred to as "electrically conductive layer (A)" or "electrically conductive polymer layer (A)" and a protective layer formed of a polyester-based polymer (B) containing substantially no electrically conductive carbon black, which may hereinafter be referred to as "protective layer (B)" or "protective polymer layer (B)."

In the present invention, the content of the electrically conductive carbon black contained in the electrically conductive layer (A) is from 23 to 33% by weight, and preferably from 25 to 30% by weight. If the content of electrically conductive carbon black is less than 23% by weight, an electrical conductivity which the present invention desires can not be obtained and a sufficient antistatic performance is not developed. On the other hand, if the content is more than 33% by weight, further improvement in electrical conductivity is not recognized and rather the fluidity of the polymer is abruptly lowered greatly and the spinnability is extremely deteriorated.

The electrically conductive carbon black used in the present invention preferably has an intrinsic electrical resistance of from $10^{-3}$ to $10^{3}$ ohm·cm. When carbon black is completely dispersed as particulates, the electrical conductivity is generally poor, whereas when carbon black forms a chain structure simply called "structure", the electrically conducting performance is improved and the carbon black is called "electrically conductive carbon black." In imparting electric conductivity to a polymer by use of carbon black, it is important to disperse the carbon black without breaking the structure.

Generally, when normal stretching is performed, the structure becomes susceptible to damage. The present invention, however, is characterized in that almost no structure has been broken though stretching because a special stretching method described below is used. Since the conventional common stretching methods are methods in which stretching is performed by force utilizing the difference in speed between rollers, fibers will be stretched by force and the structure will be broken. In the case of not a method in which the stretching is performed between rollers but a method in which a fiber is subjected to free stretching like the present invention, the structure becomes less prone to break because no excessive force is applied to the fiber.

Possible mechanisms of the electrical conduction of an electrically conductive carbon black-containing composite include mechanism by contact of carbon black chains and mechanism by the tunnel effect. However, the former is believed to be major. Therefore, the longer the carbon black chain and the more densely the carbon black exist in a polymer, the greater the contact probability is and the higher the electric conductivity is. When a polymer constituting an electrically conductive layer is crystallized and a loose structure in which amorphous portions can undergo molecular motion is formed in order to lengthen the chain, carbon black gathers in the amorphous portions and the carbon concentration in the amorphous portions increases. As a result, the electrically conducting performance is enhanced.

In the present invention, since a special spinning stretching method described below is used, the electrically conductive layer is more crystallized and the amorphous portions are in a state where the molecular motion can be allowed more in comparison to electrically conductive fibers having been subjected to normal stretching treatment. Therefore, the fiber of the present invention is excellent as an electrically conductive fiber. The electrically conductive composite fiber of the present invention obtained by a special spinning stretching method satisfies the following formulas (II) and (III) with respect to the strength (DT) and the elongation at break (DE), unlike electrically conductive fibers obtained by conventional common stretching methods including the direct spinning-drawing process or unstretched electrically conductive fibers:

$$1.8 \leqq DT \leqq 4.5 \quad \text{(II)}$$

$$50 \leqq DE \leqq 90 \quad \text{(III)}$$

wherein DT means the fiber strength (cN/dtex) and DE means the elongation at break (%).

According to the investigation results obtained by the inventors, if the polymer to which electrically conductive carbon black is added is a polyester-based polymer, when the content of electrically conductive carbon black is less than 20% by weight, almost no effect is obtained. When the content becomes 23% by weight, the electrical conductivity is improved abruptly, and when the content exceeds 25% by weight, the electrical conductivity will be almost saturated.

What is important in the present invention is to use a polyester-based polymer as the resin used for the electrically conductive layer (A). Electrically conductive fibers are typically used for working wears, dust-proof clothing, and the like in places where explosion may occur due to generation of static electricity. In the course of use for a long period, severe bending, tension, flexion, abrasion, and the like are repeated and washing is also repeated. As a result, the performance of electrically conductive layers in electrically conductive fibers is consequently degraded gradually and, therefore, the antistatic performance as clothing must be degraded. Once the electrically conductive layer is broken due to strain such as cracking and the continuity thereof is lost, it is difficult to be repaired. As a result, wearing the working wears, dust-proof clothing, and the like continuously for a long period is difficult and, at present, these must be renewed in a certain period.

Dust-proof clothing is, as mentioned above, often worn in semiconductor manufacturing sites. In such semiconductor manufacturing sites, acid is used, dust-proof clothing is thus required to have acid resistance. Most conventional electrically conductive fibers, however, include polyamide as a resin for their electrically conductive layers. In the case of including polyamide, such fibers are not resistant to acid and, therefore, conventional electrically conductive fibers may not be suitable for dust-proof clothing. When being worn in a workplace where acid is not used, dust-proof clothing may indeed be not required to have acid resistance. However, in selling dust-proof clothing, it is difficult to ask not to use it in workplaces where acid is used. Being dust-proof clothing which can be worn in any workplace is a great advantage.

In the electrically conductive composite fiber of the present invention, the polymer forming the electrically conductive layer (A) is a polyester-based polymer. Therefore, it is advantageous in having excellent acid resistance and it is suitable as clean room wears which can be worn even in a workplace where an operation in which acid is used is done, and it is characterized in that the antistatic performance of a fabric is not degraded even over its practical wearing for a long period.

Examples of the polyester-based polymer (A) used for the electrically conductive layer (A) include fiber-forming polyesters produced by using a dicarboxylic acid component, such as aromatic dicarboxylic acids, e.g., terephthalic acid, isophthalic acid, naphthalene-2,6-dicarboxylic acid, 4,4'-dicarboxydiphenyl and 5-sodium sulfoisophthalic acid; and aliphatic dicarboxylic acids, e.g., azelaic acid and sebacic acid, and a diol component, such as aliphatic diols, e.g., ethylene glycol, diethylene glycol, propylene glycol, 1,4-butanediol, polyethylene glycol and polytetramethylene glycol; aromatic diols, e.g., ethylene oxide adducts of bisphenol A or bisphenol S; and alicyclic diols, e.g., cyclohexane dimethanol. Among them, polyesters having 80 mol % or more, especially 90 mol % or more of ethylene terephthalate units or butylene terephthalate units, which are general purpose polyesters, are preferred.

In particular, polybutylene terephthalate-based resins, namely, polyester-based resins having 80 mol % or more of butylene terephthalate units are preferred because electrically conductive carbon black can be easily kneaded thereinto and they readily crystallize, and therefore high electrically conducting performance can be obtained. Polyethylene terephthalate-based resins also can be used. However, addition of a large amount of electrically conductive carbon black will result in deterioration of spinnability at the time of melt-spinning. Therefore, it is considered to use a copolymerized polyethylene terephthalate in order to enhance the spinnability. However, use of a copolymerized polyethylene terephthalate generally causes deterioration of crystallinity, which will result in degradation of electrically conducting performance. According to the facts mentioned above, polybutylene terephthalate-based resins, which are polyester resins which readily form crystals, are particularly excellent. From the practical durability viewpoint, the melting point of the resin constituting the electrically conductive layer must be 200° C. or higher, and preferably is from 210° C. to 250° C.

On the other hand, the protective layer (B) takes an important role in maintaining good processability during the fiber-forming of the present invention, preventing occurrence of interfacial peeling from the electrically conductive layer (A), and maintaining long period durability. It is important to use a fiber-forming polyester-based polymer as the polymer constituting the protective layer (B). In particular, from the durability viewpoint, thermoplastic crystalline polyester having a melting point of 210° C. or higher is used as polyester for the protective layer of the present invention. Basically, polymers poor in spinnability are not suitable as resins for the protective layer of the present invention.

Examples of such polyester-based polymer (B) include fiber-forming polyesters produced by using a dicarboxylic acid component, such as aromatic dicarboxylic acids, e.g., terephthalic acid, isophthalic acid, naphthalene-2,6-dicarboxylic acid, 4,4'-dicarboxydiphenyl and 5-sodium sulfoisophthalic acid; and aliphatic dicarboxylic acids, e.g., azelaic acid and sebacic acid, and a diol component, such as aliphatic diols, e.g., ethylene glycol, diethylene glycol, propylene glycol, 1,4-butanediol, polyethylene glycol and polytetramethylene glycol; aromatic diols, e.g., ethylene oxide adducts of bisphenol A or bisphenol S; and alicyclic diols, e.g., cyclohexane dimethanol. Among them, polyesters having 80 mol % or more, especially 90 mol % or more of ethylene terephthalate units or butylene terephthalate units, which are general purpose polyesters, are mentioned. Modified polyesters containing a small amount of third component can also be used. Moreover, such polymers may contain a small amount of additives, fluorescent whitening agents, stabilizers, etc. Such polyesters have good melt viscosity properties at the time of fiber-forming. In addition, they are excellent in fiber properties and heat resistance. From the viewpoint of fiber-forming processability, fiber properties and durability, polyethylene terephthalate-based polyesters are preferred. In particular, polyesters having a melting point of from 240° C. to 280° C. are preferred. Polyester-based polymers having a melting point from 10 to 50° C. higher than that of the polyester-based polymer (A) constituting the electrically conductive layer are preferable as the polymer for the protective layer.

Furthermore, in the present invention, the SP value (solubility parameter) ($\phi 2$) of the polyester-based resin (B) forming the protective layer (B) and the SP value ($\phi 1$) of the polyester-based resin (A) forming the protective layer (A) must satisfy the following formula (I). In a product including a combination satisfying this condition, the polymers exhibit good adhesiveness and therefore interfacial peeling hardly occurs and the product is also excellent in fiber properties. In the case of $|\phi 1-\phi 2|>1.1$, interfacial peeling tends to occur and durability in practical use can not be obtained.

$$0 \leqq |\phi 1-\phi 2| \leqq 1.1 \quad \text{(I)}$$

In this formula, $\phi 1$ means the SP value $[(\text{cal/cm}^3)^{1/2}]$ of the polyester-based polymer (A), and $\phi 2$ means the SP value $[(\text{cal/cm}^3)^{1/2}]$ of the polyester-based polymer (B).

In the present invention, it is preferable, from the viewpoint of spinnability and knitting/weaving processability of the electrically conductive composite fiber, that the polyester-based polymer (B) forming the protective layer (B) contains inorganic fine particles having an average particle diameter of from 0.01 μm to 1 μm in a content of from 0.05% by weight to 10% by weight. When the content of the inorganic fine particles is less than 0.05% by weight, the resulting electrically conductive composite fiber tends to produce loop, fluff, unevenness in fineness, etc. When the content is greater than 10% by weight, the processability in manufacture is poor and fiber breakage may be caused. It is more preferable that the inorganic fine particles are contained in a content of from 0.2% by weight to 5% by weight.

As the inorganic fine particle contained in the polyester-based polymer (B), any one can be used which has substantially no degrading action to polyester and has excellent stability. Representative examples of such inorganic fine particles include silica, alumina, titanium oxide, calcium carbonate and barium sulfate. These may be used alone or in combination.

The average particle diameter of the inorganic fine particles is preferably from 0.01 μm to 1 μm, and more preferably from 0.02 μm to 0.6 μm. When the average particle diameter is smaller than 0.01 μm, a loop, fluff, unevenness in fineness, or the like may occur in the resulting fiber even when only a slight variation is produced in the tension applied to the line of thread at the stretching. On the other hand, when the average particle diameter exceeds 1 μm, the spinnability and stretchability of a fiber are deteriorated and, as a result, breakage of fiber or twining in stretching may tend to occur. The average particle diameter herein is a value determined by the centrifugal sedimentation method.

The method of adding inorganic fine particles is not particularly limited. It is only required that inorganic fine particles are added and mixed so that the particles are uniformly mixed in a polyester at any one from the time of polymerization of the polyester to the time just before melt-spinning.

A resin containing electrically conductive carbon black kneaded therein in a high concentration is difficult to be processed alone into fiber because it is poor in spinnability and stretchability even if the resin serving as a matrix has a sufficient fiber-forming property. Therefore, the fiber-forming processability and fiber properties are maintained by conjugating the electrically conductive layer polymer (A) and the protective layer polymer (B). Although the cross-sectional form of the fiber is not particularly limited, it is preferable, from the viewpoint of electric conductivity, that the electrically conductive polymer layer (A) is exposed at least partly on the fiber surface.

One preferable embodiment of the electrically conductive composite fiber of the present invention is a fiber satisfying the following formulas (IV) to (VI). This is a fiber in which the electrically conductive layer (A) is exposed separately at a plurality of regions on the fiber surface. This embodiment is hereinafter referred to as "the first embodiment."

$$3 \leqq N \leqq 8 \quad \text{(IV)}$$

$$25 \leqq S \leqq 45 \quad \text{(V)}$$

$$1.0\times10^9 \leqq E' \leqq 6.0\times10^9 \quad \text{(VI)}$$

In the formulas N means the number of exposed portions of the electrically conductive layer, S means the surface exposed area ratio (%) of the electrically conductive layer relative to the entire surface of the fiber, and E' means the storage elastic modulus (Pa) at 10 Hz, 100° C.

In the electrically conductive composite fiber of the first embodiment, the electrically conductive polymer layer (A) is configured, from the electric conductivity viewpoint, to be exposed at least partly on the fiber surface. If the exposed area is too large, however, change in quality, degradation, exfoliation, or the like will occur in the electrically conductive polymer layer (A) containing carbon black during a fiber manufacturing step and a processing step or during practical wearing. Further, in some combination of the electrically conductive polymer layer (A) and the protective polymer layer (B), interfacial peeling occurs and it may become impossible to achieve the important objective of the present invention to maintain excellent antistatic performance over practical use for a long period. On the other hand, if the exposed area is too small, the most important performance required as an electrically conductive fiber, namely, the antistatic performance may be degraded abruptly. Based on the above, it is preferable that the ratio of the electrically conductive layer exposed on the surface of the electrically conductive fiber, that is, the surface exposed area ratio S (%) is from 25% to 45% relative to the entire surface area of the electrically conductive fiber. Amore preferable range is from 30 to 40%.

For maintaining excellent electrically conducting performance for a long period, it is preferable that the electrically conductive layer is exposed separately at a plurality of regions on the fiber surface. Specifically, it is preferable that the layer is exposed in the form of from 3 to 8 streaks on the fiber surface. When there are nine or more streaks, each streak becomes too thin, so that electrically conductive layers will become liable to breakage or, at the time of spinning, electrically conductive layers may be arranged discontinuously. On the other hand, when there are two or less streaks, the fiber surface has many portions where no electrically conductive layer is exposed and, as a result, antistatic performance may not be exhibited and it becomes highly probable that all the electrically conductive layers are broken and the electrically conducting performance is lost.

In the first embodiment, it is preferable to obtain an electrically conductive composite fiber which satisfies the formula (VI) shown above, that is, an electrically conductive composite fiber whose storage elastic modulus E' (Pa) at 10 Hz, 100° C. satisfies $1.0\times10^9 \leqq E' \leqq 6.0\times10^9$, by use of the special spinning stretching method of the present invention. Neither the electrically conductive fibers obtained by use of conventional common stretching methods, including the direct spinning-drawing process, nor unstretched electrically conductive fibers satisfies this formula. The storage elastic modulus defined herein indicates softness of fibers and durability of fibers against flexion and stretching. When the storage elastic modulus is less than $1.0\times10^9$, the fiber is hard and has insufficient durability against flexion and stretching. When it is greater than $6.0\times10^9$, the fiber may be insufficient in durability for practical use. The electrically conductive composite fibers having storage elastic moduli within the above range can be obtained by using the special spinning method of the present invention, which will be described below.

In the first embodiment, it is not preferable that the amount of the electrically conductive layer (A) containing carbon black is more than 30% by weight of the fiber because the spinnability tends to be affected and breakage of fiber during spinning or stretching will often occurs. The amount of the electrically conductive layer (A) is more preferably 15% by weight or less. From this fact, the amount of the protective layer (B) is preferably not less than 70% by weight, more preferably not less than 85% by weight, based on the fiber weight. However, the ratio of the electrically conductive layer (A) is preferably not less than 5% by weight because when the amount of the electrically conductive layer is too small, problems about continuity of the electrically conductive layer and about exposure of the layer on the fiber surface will arise. In particular, the ratio is preferably within the range of from 7 to 12% by weight.

In the first embodiment, it is preferable that the electrically conductive layer (A) is exposed on the fiber surface and the number N of the exposed portions is from 3 to 8, more preferably from 4 to 6, per one filament of electrically conductive composite fiber as mentioned above. The surface exposed area ratio S (%) of the electrically conductive layer (A) is, as described above, preferably from 25% to 45%. It is more preferable that such electrically conductive layers (A) are present almost uniformly at equal intervals in the fiber surface, from the viewpoint of resistance to breakage of the electrically conductive layers when uneven forces are applied to the fiber surface. Furthermore, from the viewpoint of durability and stability in electrically conducting performance, it is preferable that for each of the plural exposed portions, the exposed portion length $L_1$ (μm) in the circumferential length direction of the surface exposed portion in a fiber cross section is from 0.1 μl to $(2/15)\times L_2$ (μm). More preferably, it is within the range of from 0.06 to 0.12 times $L_2$. Here, the $L_2$ indicates the circumferential length (μm) of a composite fiber in a cross section of the fiber. Moreover, it is preferable, from the viewpoint of durability and stability in electrically conducting performance, that the depth [$D_1$ (μm)] of the electrically conductive layer is from $D_2/20$ to $D_2/6$. The $D_1$ is more preferably from $D_2/15$ to $D_2/8$. Here, the $D_2$ indicates the fiber diameter (μm).

Even if the number N of the exposed portions of the electrically conductive layer is three or more, when the exposed portion length $L_1$ is less than 1 μm, the electrically conductive polymer exposed on the fiber surface can come into contact with an object at a low probability at the time of frictional electrification and therefore it may become difficult to obtain a desired electrically conducting performance. In the case where the exposed portion length $L_1$ is greater than $(2/15)\times L_2$ (μm), when the depth $D_1$ is less than $D_2/20$ or more than $D_2/6$, the fiber-forming processability is poor; a resulting electrically conductive fiber is poor in abrasion resistance, and the electrically conductive layer (A) and the protective layer (B) tend to peel away. In addition, the electrically conducting performance may be degraded.

The cross-sectional composite form of the electrically conductive composite fiber of the first embodiment is not particularly limited if it satisfies the exposure conditions mentioned above. One example is a cross-sectional form shown in FIG. 1. Since the action and effect of the present invention can be fully developed, the cross-sectional form shown in FIG. 1 is preferred in which four dispersed components formed of the electrically conductive layer (A) are arranged at almost equal intervals in the periphery of the fiber cross section and a part of each dispersed component is exposed on the fiber surface. The exposed portion length ($L_1$) and the depth ($D_1$) are shown in FIG. 1.

In the electrically conductive composite fiber of the first embodiment, it is preferable, from the viewpoint of electrically conducting performance stability, durability and spinning processability, that the form of the electrically conductive layer (A) is characterized in that the ratio ($D_1/L_1$) of the thickness ($D_1$) of the electrically conductive layer relative to the length ($L_1$) of the exposed portion on the fiber surface is from 0.15 to 1.0. The ratio is more preferably within the range of from 0.20 to 0.60. From the viewpoint of durability and spinning processability, the cross-sectional shape of the electrically conductive layer (A) is preferably a shape similar to the cross-sectional shape of a biconvex lens, and more preferably is a shape such that the bulge of the face in contact with the protective layer is greater than that of the face exposed on the surface.

Another preferable embodiment of the electrically conductive composite fiber of the present invention is a sheath/core composite fiber having the electrically conductive layer (A) as a sheath component and the protective layer (B) as a core component, wherein the weight ratio of the electrically conductive layer relative to the composite fiber is from 15 to 50% by weight. This is hereinafter referred to as "the second embodiment."

The cross-sectional form of the sheath/core composite fiber in the second embodiment is not particularly limited if it satisfies the sheath/core type mentioned above. One example is a cross-sectional form such that a protective layer occupies the inside of the fiber and an electrically conductive layer covers the surface of the protective layer so that the electrically conductive layer covers at least half of the fiber surface, preferably 80% or more of the fiber surface, and more preferably the entire surface of the fiber substantially completely.

In the second embodiment, when the electrically conductive layer (A) of the sheath component containing carbon black accounts for more than 50% by weight based on the weight of the fiber, the spinnability at the time of spinning tends to be affected and breakage of fiber during spinning or stretching may often occur. The amount of the electrically conductive layer (A) is more preferably 30% by weight or less. From this fact, the protective layer (B) of the core component preferably accounts for 50% by weight of more, more preferably 70% by weight or more, based on the weight of the fiber. However, the ratio of the electrically conductive layer (A) is preferably not less than 15% by weight, and particularly preferably within the range of from 18 to 25% by weight because when the amount of the electrically conductive layer is too small, problems about continuity of the electrically conductive layer and about exposure of the layer on the fiber surface will arise.

The method for producing the electrically conductive composite fiber of the present invention uses a melt-spinning machine which is usually used for producing multicore type or single-core type sheath/core composite fibers. In order to cause the electrically conductive layer (A) to be exposed in a desired state on the fiber surface, it is preferable to adjust the alignment of the inlet port for the electrically conductive polymer and the inlet port for the protective polymer in a distributing plate in the spinning machine or to adjust the composite ratio of the polymers.

Conventionally, electrically conductive composite fibers have been produced generally by the following methods. (a) A method in which an unstretched fiber, which has only been spun, is used directly as an electrically conductive fiber. (b) A method in which a fiber is once wound onto a bobbin and then it is stretched. (c) A method in which discharged fibers are gathered on a first roller and then directly stretched without being wound, which is called "direct spinning-drawing process."

In the method (a), however, a resulting electrically conductive fiber itself has low strength and satisfactory electrically conducting performance can not be obtained because carbon black in an electrically conductive layer fails to form the structure. In the methods (b) and (c), since an electrically conductive layer is stretched by force in a fiber, the electrically conductive layer may be broken or, even if not broken, the structure of electrically conductive carbon black may be broken. Moreover, in the methods (b) and (c) have a drawback that even if an electrically conductive layer is not broken during the electrically conductive fiber production, the electrically conductive layer is broken easily when a slight external force is applied to the electrically conductive fiber in the following such as a step of fabric manufacture, a sewing step, and a timing of wearing or washing clothing and, as a result, electrically conducting performance is easily lost.

In order to solve the problems with the above-mentioned conventional method, the present invention uses a special spinning method. That is, the present invention relates to a method for producing an electrically conductive composite fiber comprising an electrically conductive layer (A) and a protective layer (B), wherein the following (1) through (5) are performed in this order in a manner that the following (6) is satisfied:

(1) merging a molten polymer liquid of the (A) and a molten polymer liquid of the (B), followed by melt-discharging through a composite spinneret, (2) cooling the discharged molten polymer temporarily to a temperature lower than a glass transition point, (3) subsequently transfer it through a heating device to subject heat-stretching treatment, (4) thereafter providing oil to it, (5) winding it at a rate of 3000 m/min or more, (6) the (1) to (3) are performed before the discharged thread comes into contact with a roller or a guide at first.

The method of the present invention is characterized in that a composite polyester filament melt-discharged is once cooled, and then is subjected to heat-stretching treatment by using a heating zone such as a tube heater, and that the operations from the melt-discharging to the heat stretching are performed substantially without allowing the filament to come into contact with rollers or guides. By use of such a method, an electrically conductive fiber is not stretched by force between rollers or between a guide and a roller, and the stretching ratio of the electrically conductive fiber is controlled automatically in a zone from a discharged spot of molten polymer to a heating device. As a result, the electrically conductive fiber is stretched but not to an extent such that the electrically conductive layer is broken. Therefore, the protective layer is stretched sufficiently and the fiber has high fiber properties. In addition, the electrically conductive layer has been stretched and crystallized and its amorphous portion is in a state where the molecular motion can be allowed. As a result, even a tension is applied to the electrically conductive layer, the layer is not broken and is stretchable greatly and, therefore, the electrically conducting performance is not lost. Regarding the heating temperature in the heat stretching, it is preferable that the temperature is not lower than the glass transition temperature of both the polymer constituting the electrically conductive layer (A) and the polymer constituting the protective layer (B), but not higher than their melting points.

In the first embodiment, in the (1) of method for producing an electrically conductive composite fiber, it is preferable to merge a molten polymer liquid of the (A) and a molten polymer liquid of the (B) at flow rates such that the ratio of the (A) relative to the total weight of the (A) and (B) is from 5 to 30% by weight, followed by melt-discharging through a composite spinneret. In the second embodiment, it is preferable to merge a molten polymer liquid of the (A) and a molten polymer liquid of the (B) so that the (A) becomes a sheath component and the (B) becomes a core component, at flow rates such that the ratio of the (A) relative to the total weight of the (A) and (B) is from 15 to 50% by weight, followed by melt-discharging through a composite spinneret.

As the result, the electrically conductive composite fiber of the present invention has fiber strength (DT) of from 1.8 cN/dtex to 4.5 cN/dtex. When the fiber strength is less than 1.8 cN/dtex, the fiber has been stretched insufficiently and the crystallization of the electrically conductive layer is achieved insufficiently. Therefore, the electrical conductivity is deteriorated. When the fiber strength is more than 4.5 cN/dtex, the electrically conductive composite fiber has been stretched excessively, resulting in failure to obtain durability of electrical conductivity. Such fiber strength can be achieved easily by the special spinning method described above.

The elongation at break (DE) of the electrically conductive composite fiber of the present invention is from 50% to 90%. When the elongation at break is less than 50%, this means that the fiber has been stretched excessively and there is a problem that the electrically conductive layer tends to be broken. When the elongation at break is more than 90%, this means that the electrically conductive composite fiber has not been stretched sufficiently. In this case, satisfactory fiber properties, of course, can not be obtained and electrical conductivity also is not satisfactory. Such an elongation at break can also be achieved easily by the special spinning method described above.

Then, oil is supplied with an oil supplying unit to the electrically conductive composite fiber of the present invention having been spun and stretched in the way described above. The fiber is subsequently subjected, if necessary, to air entangling treatment using an interlacer or the like and then wound at a winding rate of 3000 m/min or more, preferably from 3000 m/min to 4500 m/min via a haul-off roller. When the winding rate is less than 3000 m/min, the durability for practical use becomes insufficient and it may be impossible to obtain desired electrically conductive composite fibers.

Regarding the cooling step (2), by adjusting the temperature of the cooling wind to from about 20 to 30° C., the humidity of the cooling wind to from about 20 to 60%, and the blowing rate of the cooling wind to from about 0.4 to 1 m/sec, it is possible to obtain high-quality fibers without causing unevenness in fineness and variation in performance. For stretching uniformly and smoothly, the length of the heating zone used in the (3) is preferably from 0.6 m to 4 m, and the temperature of the heating zone is preferably from 150° C. to 220° C.

The monofilament fineness of the electrically conductive composite fiber of the present invention obtainable in such a method is not particularly limited, and it may be approximately from 2 to 30 dtex, depending upon the application. A particularly preferable embodiment is a multifilament composed of from 3 to 6 of such electrically conductive composite fibers bundled, wherein the multifilament has a total fineness of from 10 to 40 dtex. When a multifilament is formed from electrically conductive composite fibers as mentioned above, even if an electrically conductive layer in one filament is broken, the electrically conducting performance of the entire multifilament is not affected because the remaining filaments have electrical conductivity. However, when the total fineness of the multifilament or the number of the filaments therein is small, a sufficient electrical conductivity is not obtained. Conversely, when the total fineness or the number of the filaments in a multifilament is large, incorporation of electrically conductive composite fibers makes black color noticeable in clothing, affecting the aesthetic property.

In the present invention, regarding the electrically conductive polymer layer (A), it becomes easy to design a composite fiber which can develop electrically conducting performance even in a low-frictional charging voltage environment. In other words, it becomes easy to cause an electrically conductive polymer layer (A) to be exposed at least partly on the fiber surface.

The electrical resistance $R_0$(Ω/cm·f) of the electrically conductive composite fiber of the present invention may be adjusted appropriately depending on the application, but it preferably satisfies the following formulas. By use of the method described above, an electrically conductive composite layer which satisfies the following formulas can be obtained easily.

$$1\times10^6<R_0<9\times10^9 \quad (7)$$

$$0\leqq|\log(R_1/R_0)|<2 \quad (8)$$

$$1\leqq DEd\leqq20 \quad (9)$$

In the formulas, $R_0$ is a yarn resistance (Ω/cm·f) at 0 HL (washing-free), $R_1$ is a yarn resistance (Ω/cm·f) after 100 HL (after washing repeated 100 times), and DEd is a critical elongation, which is the elongation at break (%) at a time when the yarn resistance reaches 1012 Ω/cm·f.

In a range where $R_0$ satisfies the formula (7), the fact that the absolute value of $\log(R_1/R_0)$ is smaller than 2 means that the fiber is excellent in washing resistance and there is no problem in practical use. When the absolute value is greater than 2, the durability in practical use is insufficient. When the critical elongation (DEd) is less than 1% or greater than 20%, durability in practical use is not obtained.

The electrically conductive composite fiber of the present invention may be used in various forms to various applications where antistatic properties are required. For example, it can be used in a manner that a yarn is made from an electrically conductive multifilament of the present invention and an electrically non-conductive multifilament in combination so that the electrically conductive multifilament becomes a side yarn and the electrically non-conductive multifilament becomes a core yarn and the electrically conductive multifilament is longer in the range of from 1 to 30%. As the core yarn, a polyester-based multifilament is preferred. The total thickness of the electrically non-conductive multifilament which serves as a core yarn is preferably within the range of from 20 to 120 dtex. In fabricating into a combined filament yarn, it is common to provide entanglement to a core yarn and a side yarn so that they are not separated. After the provision of such entanglement, the combined filament yarn may be twisted.

It is also permitted that an electrically non-conductive multifilament is used as a core yarn and an electrically conductive multifilament is wound spirally therearound. As the core yarn, one having a thickness the same as that in the case of the aforementioned combined filament yarn is used. Similarly, a polyester-based multifilament is preferable as the core yarn. Such a multifilament yarn using an electrically conductive composite fiber is arranged at a density of one in every 5 mm to 50 mm distances as a part of warps and/or wefts in a textile such as woven fabric or knitted fabric. As a result, the textile obtained comes to have antistatic performance.

Such a textile is used in applications where antistatic property is required. For example, it can be used as dust-proof clothing which is worn in a clean room, or as a antistatic working wear for a worker who works in a site where explosion may be caused by static electricity, like a worker working in a chemical plant or a worker who handles chemicals. Furthermore, the electrically conductive composite fiber of the present invention can be used as a part of pile of antistatic carpet and as an antistatic brush of a copying machine.

EXAMPLES

The present invention will be described in detail below by way of Examples, by which, however, the invention is not limited at all. Evaluations were carried out in the methods provided below.

[Electrical Resistance R]

By voltmeter ammeter method, a DC voltage of from 25 to 500V was applied to a sample of an electrically conductive fiber (monofilament) which was held between parallel clip electrodes, and the electrical resistance was calculated in accordance with Ohm's law from the voltage and the current which flew in the sample at that voltage. The electrical resistance provided in the present invention is a value determined by applying a voltage of 100 V.

[Charge Quantity]

Evaluation of the antistatic performance of a fiber was conducted by measuring the amount of charge generated due to friction when an electrically conductive fiber was incorporated in a textile in accordance with JIS L1094. A sample was left at rest for 24 hours in a room conditioned at a temperature of 22° C. and a relative humidity of 40%. Then, the measurement was conducted in the room.

[Measurement of Fiber Strength and Elongation at Break]

Measurement was conducted in accordance with JIS L1013 at a fiber length of 10 cm, an elongation rate of 100%/min, and room temperature.

[Evaluation of Acid Resistance]

An electrically conductive fiber was incorporated in a textile and the textile was immersed in a 3% by weight aqueous solution of sulfuric acid for 24 hours. Then, the sample textile was dried naturally for 24 hours, followed by washing with water. Thereafter, the strength of the electrically conductive fiber was measured.

A: Strength retention rate is 95% or more.

B: Strength retention rate is not less than 70%, but less than 95%.

C: Strength retention rate is less than 70%.

Strength retention rate={(strength before treatment−strength after treatment)/strength before treatment)×100}

[Measurement of Storage Elastic Modulus E' at 10 Hz, 100° C.]

The storage elastic modulus is determined through measurement of dynamic viscoelasticity.

Instrument: DVE-14 FT Rheospectrer (produced by UBM)

Measuring conditions: fiber length 1 cm, frequency 10 Hz, displacement 5 μm, rate of heating 3° C./min (from −100° C. to 250° C.)

[Measurement of yarn resistance $R_0$ at 0 HL, and yarn resistance $R_1$ after 100 HL]

By voltmeter ammeter method, a DC voltage of from 25 to 500V was applied to a sample of an electrically conductive fiber (monofilament) which was held between parallel clip electrodes, and the electrical resistance was calculated in accordance with Ohm's law from the voltage and the current which flew in the sample at that voltage. The electrical resistance provided in the present invention is a value determined by applying a voltage of 100 V.

[Measurement of Critical Elongation (Elongation (%) at the Arrival of Yarn Resistance at $10^{12}$ Ω/cm·f)]

The resistance of a yarn which has been elongated with an strength and elongation tester is measured. The measurement of the resistance is conducted in accordance with the above.

[Solubility Parameter: SP Value]

The SP value is a value calculated from ρΣG/M, wherein G is a cohesive energy constant of an atom or an atomic group, and M is a molecular weight of a structural unit.

[The Number N of Exposed Portions of Electrically Conductive Layer, and the Surface Exposed Area Ratio S of Electrically Conductive Layer]

Ten fiber cross sections are chosen arbitrarily from an electron micrograph (×2,000) of fiber cross sections and measurements were conducted. Average values of the measured values are determined.

[Average Particle Diameter of Inorganic Fine Particles]

The average particle diameter of inorganic particles means an average diameter of primary particles measured by the centrifugal sedimentation method.

Example 1

A polybutylene terephthalate (PBT, melting point=225° C.) containing 25% by weight of electrically conductive carbon black was used as the component for the electrically conductive polymer layer (A) and a polyethylene terephthalate (PET, melting point=255° C.) containing 0.5% by weight of titanium oxide having an average particle diameter of 0.4 μm was used as the component for the protective polymer layer (B). Using these materials, composite spinning was performed, at a composite ratio of 10/90 (wt %) and in a core-exposed cross section with a four-core sheath-core. Thus, an electrically conductive composite multifilament composed of an aggregate of four composite filaments was obtained, the total fineness of which was 22 dtex. As a spinning method, the following was used: a method including merging a melt of the (A) and a melt of the (B), followed by melt-discharging through a composite spinneret; cooling the discharged molten polymer temporarily to a temperature lower than a glass transition temperature; subsequently transfer it through a heating device to subject heat-stretching treatment; thereafter providing oil to it; and winding it at a rate of 3500 m/min. In the spinning method, the heat-stretching treatment was performed before the aforementioned discharged thread came into contact with a roller or a guide at first. As the cooling method, cooling wind at 25° C. was blown to the fiber just below a nozzle at a rate of 0.5 m/sec. As the method of the heat-stretching treatment, a method in which a heating tube having a diameter of 3 cm and a length of 1 m was arranged 1.5 m directly under the nozzle and the inside of the tube was kept at 180° C. was used. The fiber-forming processability was good and satisfactory. The composition and the fiber-forming conditions of this electrically conductive composite fiber are shown collectively in Table 1. The values about the cross-sectional shape of this electrically conductive fiber are shown in Table 3.

In the electrically conductive composite fiber obtained, the electrically conductive polymer layer (A) continued uniformly along the axial direction of the fiber. The number of the exposed portions of the electrically conductive polymer layer (A) on the fiber surface was 4. For each exposed portion, the length $L_1$ (μm) of the exposed portion of the electrically conductive polymer layer (A) along the circumferential length direction in the fiber cross section was 7.4 μm and the condition $0.1 \leqq L_1$ (μm)$\leqq (2/15)L_2$ was satisfied. The area of the exposed portions of the electrically conductive layers on the surface was 42% based on the area of the entire fiber. The depth $D_1$ of the electrically conductive layers was 1/9 of the fiber diameter. Each electrically conductive layer was similar in cross-sectional shape to the cross-sectional shape of a biconvex lens and had a shape such that the surface in contact with the protective layer was much convex than the exposed surface. The electrical resistance of the composite fiber under application of a voltage of from 25 to 500V was $(6.2\pm2)\times10^7$ Ω/cm·f, that is, log R=7.79 to 7.91 and it was extremely stable. The composite fiber had excellent electrically conducting performance even under a low voltage application. The storage elastic modulus (E') at 10 Hz, 100° C. was $4.0\times10^9$ Pa.

Subsequently, the resulting electrically conductive composite multifilament was wound spirally around a blended yarn of polyester (polyethylene terephthalate)/cotton=65/35 to cover it and then was arranged in warps made of polyester (polyethylene terephthalate)/cotton=65/35 having a cotton count of 20S/2 in a ratio of one in every 80 warps to form a 2/1 twill weave having 80 warps/inch and 50 wefts/inch. Subsequently, the weave was subjected to dyeing and finishing under normal conditions for polyester-cotton mixed fabric.

The surface resistance of the weave was $10^7$ Ω/cm. It had a surface resistance of $10^7$ Ω/cm even after two-year practical wearing and washing repeatedly 250 times. Thus, it had excellent antistatic performance and the durability of the antistatic performance was also excellent. The evaluation results of the electrically conducting performance of the resulting fiber and weave are shown in Table 2.

Examples 2 to 5

Electrically conductive fibers were obtained in the same manner as Example 1, except for using, as the protective layer (B), those given in Examples 2 to 4 in Table 1, respectively, and adjusting the number of the exposed portions of the electrically conductive polymer layer to the number shown in Example 5. In every Example, both the acid resistance and the electrical performance were good. The evaluation results are shown in Tables 1 and 2. The values about the cross-sectional shapes of these electrically conductive fibers are shown in Table 3.

TABLE 1

Figure 2:
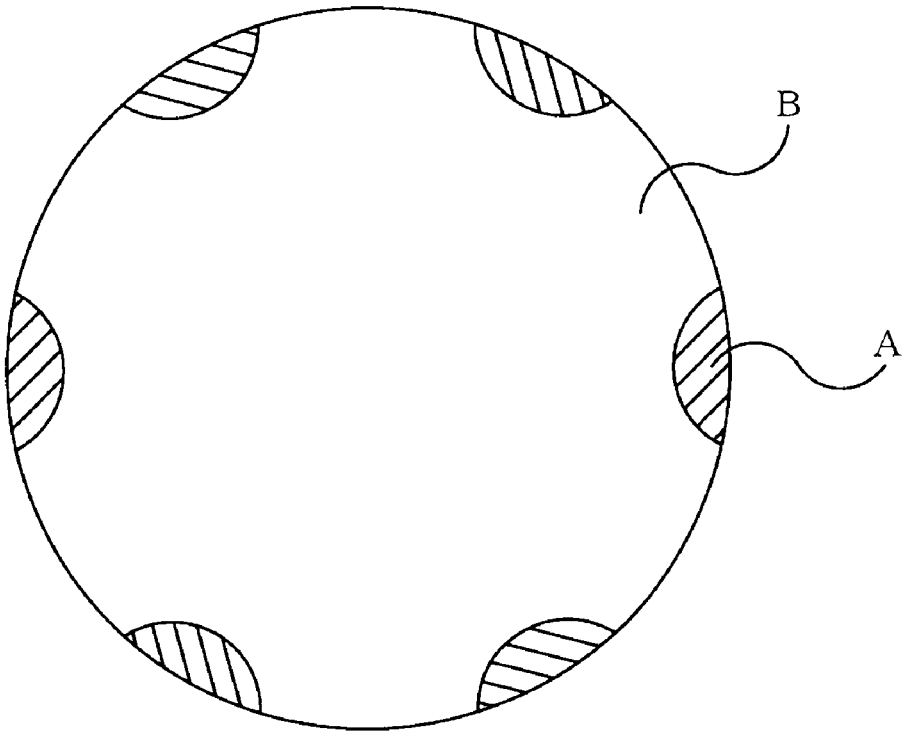
FIG. 2 A cross sectional view showing one example of the composite form of the electrically conductive composite fiber of the present invention.
Figure 3:
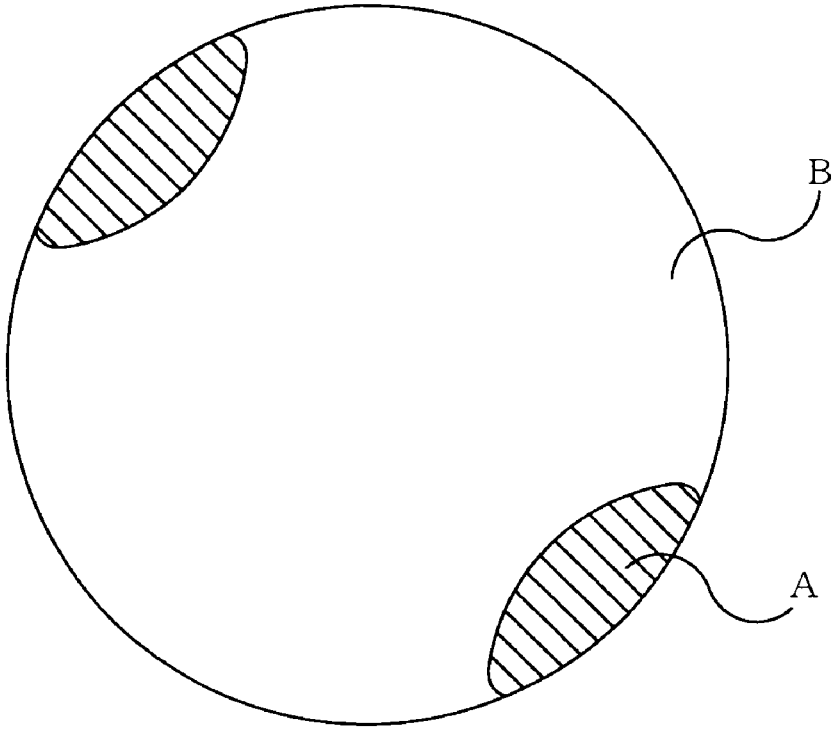
FIG. 3 A cross sectional view showing one example of the composite form of the electrically conductive composite fiber of the present invention.
Figure 4:
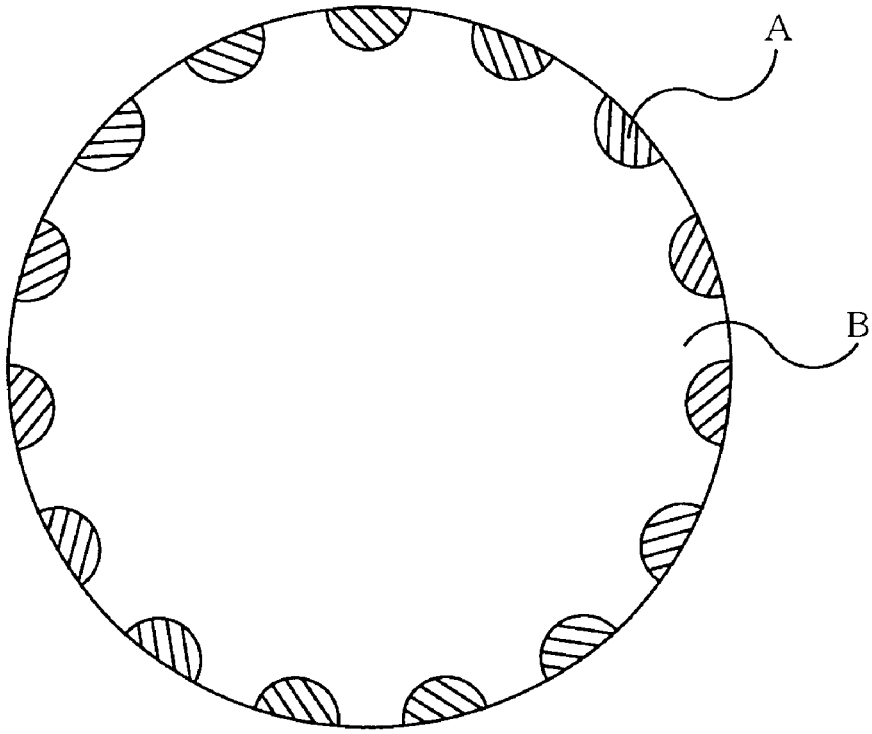
FIG. 4 A cross sectional view showing one example of the composite form of the electrically conductive composite fiber of the present invention.

| | Polyester-based polymer (A) | | | Polyester-based polymer (B) | | | | | | |
|---|---|---|---|---|---|---|---|---|---|---|
| | Type of polymer | Amount of carbon black (wt %) | SP value φ1 $(cal/cm^3)^{1/2}$ | Type of polymer | Type of fine particles | Amount of fine particles (wt %) | SP value φ2 $(cal/cm^3)^{1/2}$ | Composite ratio A/B (wt %) | Cross-sectional shape | Spinning rate (m/min) |
| Example 1 | PBT | 25 | 10 | PET | $TiO_2$ | 0.5 | 10.7 | 1/9 | FIG. 1 | 3500 |
| Example 2 | PET | 25 | 10.7 | PET | $TiO_2$ | 0.5 | 10.7 | 1/9 | FIG. 1 | 3500 |
| Example 3 | IPAcoPET | 25 | 10.7 | PET | $TiO_2$ | 0.5 | 10.7 | 1/9 | FIG. 1 | 3500 |
| Example 4 | SIPcoPBT | 25 | 10 | IPAcoPET | $SiO_2$ | 3 | 10.7 | 1/9 | FIG. 1 | 3500 |
| Example 5 | PBT | 25 | 10 | PET | $TiO_2$ | 0.5 | 10.7 | 1/13 | FIG. 2 | 3500 |
| Example 6 | PBT | 25 | 10 | PET | $TiO_2$ | 0.5 | 10.7 | 1/9 | FIG. 3 | 3500 |
| Example 7 | PBT | 25 | 10 | PET | $TiO_2$ | 0.5 | 10.7 | 1/9 | FIG. 4 | 3500 |
| Example 8 | PBT | 25 | 10 | PET | $TiO_2$ | 0.5 | 10.7 | 1/9 | FIG. 1 | 3500 |
| Example 9 | PBT | 25 | 10 | PET | $TiO_2$ | 0.5 | 10.7 | 4/6 | FIG. 1 | 3500 |
| Comparative Example 1 | Ny6 | 35 | 12 | Ny6 | $TiO_2$ | 0.5 | 12 | 1/9 | FIG. 1 | 3500 |
| Comparative Example 2 | Ny6 | 35 | 12 | PET | $TiO_2$ | 0.5 | 10.7 | 1/9 | FIG. 1 | 3500 |
| Comparative Example 3 | PE | 40 | 8 | PET | $TiO_2$ | 0.5 | 10.7 | 1/9 | FIG. 1 | 3500 |
| Comparative Example 4 | PBT | 25 | 10 | PET | $TiO_2$ | 0.5 | 10.7 | 1/9 | FIG. 1 | 1000 |
| Comparative Example 5 | PBT | 25 | 10 | PET | $TiO_2$ | 0.5 | 10.7 | 1/9 | FIG. 1 | 3800 |

PBT: Polybutylene terephthalate
PET: Polyethylene terephthalate
$IPA_{co}PET$: Isophthalic acid-copolymerized polyethylene terephthalate
$SIP_{co}PBT$: 5-Sodium sulfoisophthalate-copolymerized polybutylene terephthalate
Ny6: Nylon 6
PE: Polyethylene

TABLE 2

| | $\lvert\phi 1-\phi 2\rvert$ | N | S (%) | $R_0$ ($\Omega$/cm · f) | $R_1$ ($\Omega$/cm · f) | $\lvert\log(R_1/R_0)\rvert$ | DT (cN/dtex) | DE (%) | DEd (%) | Acid resistance |
|---|---|---|---|---|---|---|---|---|---|---|
| Example 1 | 0.7 | 4 | 42 | $2.4 \times 10^8$ | $2.5 \times 10^8$ | 0.02 | 2.5 | 71 | 10 | A |
| Example 2 | 0 | 4 | 37 | $3.6 \times 10^8$ | $5.4 \times 10^8$ | 0.18 | 2.8 | 68 | 9 | A |
| Example 3 | 0 | 4 | 35 | $4.0 \times 10^8$ | $6.1 \times 10^8$ | 0.18 | 2.8 | 70 | 12 | A |
| Example 4 | 0.7 | 4 | 40 | $7.2 \times 10^7$ | $2.1 \times 10^8$ | 0.46 | 2.4 | 80 | 8 | A |
| Example 5 | 0.7 | 6 | 42 | $6.8 \times 10^7$ | $8.9 \times 10^7$ | 0.12 | 2.5 | 72 | 10 | A |
| Example 6 | 0.7 | 2 | 21 | $5.6 \times 10^8$ | $6.2 \times 10^8$ | 0.04 | 2.9 | 66 | 12 | A |
| Example 7 | 0.7 | 15 | 72 | $8.9 \times 10^7$ | $2.2 \times 10^{10}$ | 2.4 | 2.4 | 74 | 13 | B |
| Example 8 | 0.7 | 4 | 1 | $6.9 \times 10^9$ | $8.1 \times 10^9$ | 0.07 | 2.8 | 64 | 10 | A |
| Example 9 | 0.7 | 4 | 70 | $6.6 \times 10^7$ | $5.2 \times 10^{10}$ | 2.9 | 2.3 | 78 | 15 | B |
| Comparative Example 1 | 0 | 4 | 15 | $2.1 \times 10^7$ | $5.4 \times 10^7$ | 0.41 | 2.2 | 87 | 15 | C |
| Comparative Example 2 | 1.3 | 4 | 16 | $4.1 \times 10^7$ | $5.6 \times 10^7$ | 0.13 | 2.8 | 60 | 25 | C |
| Comparative Example 3 | 2.7 | 4 | 28 | $2.6 \times 10^7$ | $8.7 \times 10^{11}$ | 4.52 | 2 | 90 | 0 | A |
| Comparative Example 4 | 0.7 | 4 | 35 | $8.0 \times 10^9$ | $5.2 \times 10^{10}$ | 0.8 | 3.2 | 40 | 0 | A |
| Comparative Example 5 | 0.7 | 4 | 36 | $7.1 \times 10^7$ | $2.4 \times 10^{10}$ | 2.5 | 1.5 | 120 | 12 | A |

TABLE 3

| | Exposed portion length $L_1$ (μm) | Storage elastic modulus E' (Pa) | Surface exposed area ratio S of the electrically conductive layer (%) | Depth $D_1$ of electrically conductive layer (μm) | Cross-sectional shape |
|---|---|---|---|---|---|
| Preferable range | 0.1 or more, $(2/15) \times L_2$ or less | $1.0 \times 10^9$ or more, $6.0 \times 10^9$ or less | 25 or more, 45 or less | $D_2/20$ or more, $D_2/6$ or less | Biconvex lens |
| Example 1 | 7.4 | $4.0 \times 10^9$ | 42 | $D_2/9$ | Biconvex lens |
| Example 2 | 6.5 | $2.8 \times 10^9$ | 37 | $D_2/7$ | Biconvex lens |
| Example 3 | 6.2 | $2.5 \times 10^9$ | 35 | $D_2/6$ | Biconvex lens |
| Example 4 | 7.0 | $4.5 \times 10^9$ | 40 | $D_2/8$ | Biconvex lens |
| Example 5 | 5.0 | $4.2 \times 10^9$ | 42 | $D_2/13$ | Biconvex lens |

Comparative Examples 1 to 3

Operations were performed in the same manner as Example 1 using the polymers given in Table 1 for the electrically conductive polymer layer (A) and the protective polymer layer (B). However, the acid resistance was poor in Comparative Examples 1 and 2, and the fiber-forming processability was poor in Comparative Examples 2 and 3 due to exfoliation of an electrically conductive layer and a protective polymer layer.

Examples 6 to 7

Operations were performed under the same conditions as Example 1 except for changing the number of exposed portions of an electrically conductive polymer layer. However, electrical properties were insufficient in Example 6 and acid resistance was insufficient in Example 7.

Examples 8 to 9

Operations were performed under the same conditions as Example 1 except for designing the fiber cross section as shown in FIG. 1 and changing the exposure length of one electrically conductive layer to the number given in Table 2 by changing the position of the electrically conductive layer or changing the electrically conductive layer ratio. However, electrical properties were insufficient in Example 8. In Example 9, fluff and thread breakage occurred.

Comparative Example 4

Operations were performed in the same manner as Example 1 except for changing the spinning and stretching conditions as follows: spinning at a spinning rate of 1000 m/min, and then stretching by use of a stretching machine including a hot roller (HR), a cold roller (CR) and a hot plate (HP) arranged therebetween while adjusting the surface speed of the CR to 2.8 times the surface speed of the HR, the surface temperature of the HR to 80° C., and the HP arranged between the HR and the CR to 120° C., setting the discharging rate so as to achieve 22 dtex after the stretching, and adjusting the elongation at break to 40%. However, the durability of electric properties was poor.

Comparative Example 5

Operations were performed in the same manner as Example 1 except for changing the spinning and stretching conditions as follows: winding at a spinning rate of 3800 m/min (no stretching) and adjusting the elongation at break and the strength to 120% and 1.5 cN/dtex, respectively. However, the durability of electric properties was poor.

Example 10

For an electrically conductive polymer layer (A) as a sheath component, a polybutylene terephthalate (PBT: melting point=225° C.) containing 25% by weight of electrically conductive carbon black was used, and for a protective polymer layer (B) as a core component, a polyethylene terephthalate (PET: melting point=255° C.) containing 0.5% by weight of titanium oxide having an average particle diameter of 0.4 μm was used. Using these materials, composite spinning was performed at a composite ratio (sheath/core) of 15/85 (wt %) with a sheath/core cross section (single core). Thus, an electrically conductive composite multifilament composed of an aggregate of four composite filaments having a total fineness of 22 dtex was obtained. A spinning method the same as Example 1 was used. The fiber-forming processability was good and satisfactory. The composition and the evaluation results of this electrically conductive composite fiber are shown collectively in Table 4. The entire surface of this electrically conductive composite fiber was covered with an electrically conductive layer.

In the electrically conductive composite fiber obtained, the electrically conductive polymer layer (A) continued uniformly along the axial direction of the fiber. The electrical resistance of the composite fiber under application of a voltage of from 25 to 500 V was $(8.0\pm2)\times10^6$ Ω/cm·f and it was extremely stable. The composite fiber had excellent electrically conducting performance even under a low voltage application. The resulting fiber was fabricated into tubular knitting, the performance of which was as good as at a level of $10^6$ Ω/cm·f even after both 100 HL and 200 HL.

Then, the resulting electrically conductive composite multifilament was fabricated into a 2/1 twill weave in the same way as Example 1 and was subsequently subjected to dyeing and finishing under normal conditions for polyester-cotton mixed fabric. As a result, the surface resistance of the fabric was $10^7$ Ω/cm. It had a surface resistance of $10^7$ Ω/cm even after two-year practical wearing and washing repeatedly 250 times. Thus, it had excellent antistatic performance and the durability of the antistatic performance was also excellent.

Examples 11 to 13

Electrically conductive composite multifilaments were formed in the same manner as Example 10 except that the electrically conductive layer (A) and the protective polymer layer (B) formed a sheath and a core, respectively and the ratio thereof was adjusted to the values of Examples 11 to 13 in Table 4. The products were subjected to performance evaluation. The results of the evaluations of the electrically conductive fibers obtained and the weaves produced therefrom were good. That is, it was confirmed that both the spinnability and the performance are good where the weight ratio of an electrically conductive layer is within the range of from 15% by weight to 50% by weight. In these electrically conductive composite fibers, the fiber surface was covered completely with an electrically conductive layer.

Example 14

An electrically conductive composite multifilament was formed in the same manner as Example 10 except that the electrically conductive layer (A) and the protective polymer layer (B) formed a sheath and a core, respectively and the ratio thereof was adjusted to the value of Example 14 in Table 4. The product was subjected to performance evaluation. As the results of the evaluations, both the resulting electrically conductive fiber and the weave produced therefrom were inferior in performance to the fiber of Example 10. The fiber surface was covered unevenly with the electrically conductive layer. There were some portions which were not covered with an electrically conductive layer and in which the protective layer of the core component was exposed.

Comparative Example 6

An electrically conductive composite multifilament was formed in the same manner as Example 10 except that spinning was performed at a spinning rate of 1000 m/min and then stretching was performed by use of a stretching machine including a hot roller (HR), a cold roller (CR) and a hot plate (HP) arranged therebetween at an HR temperature of 80° C., a hot plate temperature of 120° C. and a stretching ratio of 2.8. The product was subjected to performance evaluation. As the results of the evaluations, both the resulting electrically conductive fiber and the weave produced therefrom were inferior in performance to the fiber of Example 10.

Comparative Example 7

An electrically conductive composite multifilament was formed in the same manner as Example 10 except that the spinning rate was changed to 3800 m/min and no heat-stretching treatment was performed. The product was subjected to performance evaluation. As the results of the evaluations, the spinnability was poor and both the resulting electrically conductive fiber and the weave produced therefrom were inferior in performance to the fiber of Example 10.

TABLE 4

| | Example 10 | Example 11 | Example 12 | Example 13 | Example 14 | Comparative Example 6 | Comparative Example 7 |
|---|---|---|---|---|---|---|---|
| Main component of core | PET | PET | PET | PET | PET | PET | PET |
| Main component of sheath | PBT | PBT | PBT | PBT | PBT | PBT | PBT |
| $\lvert\phi1-\phi2\rvert$ | 0.7 | 0.7 | 0.7 | 0.7 | 0.7 | 0.7 | 0.7 |
| Carbon content of sheath (wt %) | 25 | 25 | 25 | 25 | 25 | 25 | 25 |
| Sheath/core (wt %) | 15/80 | 20/80 | 30/70 | 50/50 | 10/90 | 15/85 | 15/85 |
| Spinning rate (m/min) | 3500 | 3500 | 3500 | 3500 | 3500 | 1000 | 3800 |
| Spinnability | Good | Good | Good | Good | Good | Good | Poor |

TABLE 4-continued

| | Example 10 | Example 11 | Example 12 | Example 13 | Example 14 | Comparative Example 6 | Comparative Example 7 |
|---|---|---|---|---|---|---|---|
| Fineness (dtex) | 22 | 22 | 22 | 38 | 38 | 22 | 22 |
| Strength (cN/dTex) | 3.2 | 3.1 | 2.9 | 2.5 | 3.2 | 3.8 | 1.4 |
| Elongation at break (%) | 72 | 74 | 75 | 77 | 70 | 35 | 130 |
| Original yarn resistance (Ω/cm · f) | $8 \times 10^6$ | $6 \times 10^6$ | $5 \times 10^6$ | $2 \times 10^6$ | $8 \times 10^9$ | $8 \times 10^9$ | $4 \times 10^6$ |
| Yarn resistance after 100 HL (Ω/cm · f) | $10^6$ | $10^6$ | $10^6$ | $10^6$ | $10^9$ | $10^{10}$ | $10^{10}$ |
| Yarn resistance after 200 HL (Ω/cm · f) | $10^7$ | $10^7$ | $10^6$ | $10^6$ | $10^{10}$ | $10^{11}$ | $10^{11}$ |
| Acid resistance | B | B | B | B | B | B | B |

In the present invention, by producing an electrically conductive composite fiber having a specific cross-sectional shape by a special composite spinning method using a polyester-based resin containing a given amount of electrically conductive carbon black as an electrically conductive layer (A) and a fiber-forming thermoplastic polyester as a protective layer (B), it is possible to obtain an electrically conductive composite fiber that has a superior antistatic performance, which is not degraded very much over a practical wearing for a long term, though it contains only a relatively small amount of electrically conductive carbon black in comparison to conventional electrically conductive fibers, and that is suitable for the field of clothing such as clean room wears and working wears.

The invention claimed is:

1. An electrically conductive composite fiber comprising an electrically conductive layer formed of a polyester-based polymer (A) having a melting point of 200° C. or higher and comprising from 23 to 33% by weight of electrically conductive carbon black, and a protective layer formed of a polyester-based polymer (B) having a melting point of 210° C. or higher, wherein the electrically conductive composite fiber satisfies the following formulas (I) to (III):

$$0 \leqq |\phi 1 - \phi 2| \leqq 1.1 \quad \text{(I)}$$

$$1.8 \leqq DT \leqq 4.5 \quad \text{(II)}$$

$$50 \leqq DE \leqq 90 \quad \text{(III)},$$

wherein $\phi 1$ means an SP value $[(cal/cm^3)^{1/2}]$ of the polyester-based polymer (A), $\phi 2$ means an SP value $[cal/cm^3)^{1/2}]$ of the polyester-based polymer (B), DT means the fiber strength (cN/dtex), and DE means the elongation at break (%).

2. The electrically conductive composite fiber according to claim 1, which satisfies the following formulas (IV) to (VI):

$$3 \leqq N \leqq 8 \quad \text{(IV)}$$

$$25 \leqq S \leqq 45 \quad \text{(V)}$$

$$1.0 \times 10^9 \leqq E' \leqq 6.0 \times 10^9 \quad \text{(VI)},$$

wherein N means the number of exposed portions of the electrically conductive layer, S means the surface exposed area ratio (%) of the electrically conductive layer relative to the entire surface of the fiber, and E' means the storage elastic modulus (Pa) at 10 Hz, 100° C.

3. The electrically conductive composite fiber according to claim 2, wherein in a profile of the electrically conductive layer in a cross section of the fiber taken along the direction perpendicular to the axis of the fiber, the ratio ($D_1/L_1$) of the thickness ($D_1$) of the electrically conductive layer to the length ($L_1$) of an exposed portion on the fiber surface is from 0.15 to 1.0.

4. The electrically conductive composite fiber according to claim 2, wherein the cross-sectional shape of the electrically conductive layer is a shape similar to the cross-sectional shape of a biconvex lens and the weight ratio of the electrically conductive layer to the fiber is within the range of from 5 to 15% by weight.

5. The electrically conductive composite fiber according to claim 1, wherein the fiber is a sheath/core composite fiber having the electrically conductive layer as a sheath component and the protective layer as a core component and the weight ratio of the electrically conductive layer relative to the composite fiber is within the range of from 15 to 50% by weight.

6. The electrically conductive composite fiber according to claim 1, wherein the polyester-based polymer (A) forming the electrically conductive layer is a polybutylene terephthalate-based resin and the polyester-based resin (B) forming the protective layer is a polyethylene terephthalate-based resin.

7. The electrically conductive composite fiber according to claim 1, wherein the polyester-based resin (B) forming the protective layer comprises inorganic particles having an average particle diameter of from 0.01 to 1 μm in an amount of from 0.05 to 10% by weight.

8. A multifilament comprising a bundle of from 3 to 6 fibers each being the electrically conductive composite fiber according to claim 1, wherein the multifilament has a total fineness of from 10 to 40 dtex.

9. A dust-proof clothing comprising a fabric in which the electrically conductive composite fiber according to claim 1 is arranged as a warp or a well at intervals.

10. A method for producing an electrically conductive composite fiber by compositely spinning a polyester-based polymer (A) having a melting point of 200° C. or higher and comprising from 23 to 33% by weight of electrically conductive carbon black and a polyester-based polymer (B) having a melting point of 210° C. or higher, wherein the following (1) to (5) are performed in this order in a manner that the following (6) is satisfied:

(1) merging a molten polymer liquid of the (A) and a molten polymer liquid of the (B), followed by melt-discharging through a composite spinneret, (2) cooling the discharged molten polymer temporarily to a temperature lower than a glass transition point, (3) subsequently transfer the cooled discharged molten polymer to obtain a discharged thread through a heating device to a subject heat-stretching treatment, (4) thereafter providing an oil to the discharged thread, (5) winding the discharged thread at a rate of 3000 m/min or more, (6) the (1) to (3) are performed before the discharged thread comes into contact with a roller or a guide at first.

* * * * *